United States Patent [19]

Bondy et al.

[11] Patent Number: 4,641,387

[45] Date of Patent: Feb. 10, 1987

[54] BED ENCLOSURE

[75] Inventors: Daniel A. Bondy, Sylvania; Judith A. East, Toledo; Christina M. Rizzo, Sylvania, all of Ohio

[73] Assignee: St. Vincent Medical Center, Toledo, Ohio

[21] Appl. No.: 826,098

[22] Filed: Feb. 6, 1986

[51] Int. Cl.[4] ..... E04C 1/40

[52] U.S. Cl. ..... 5/508; 5/284; 5/97

[58] Field of Search ..... 5/61, 97, 105, 107, 5/284, 424, 508, 509, 512

[56] References Cited

U.S. PATENT DOCUMENTS

| | | | |
|---|---|---|---|
| 306,390 | 10/1884 | Fahrney | 5/284 |
| 3,165,760 | 1/1965 | Abajian | 5/97 |
| 3,546,721 | 12/1970 | Cleary | 5/97 |
| 4,109,329 | 8/1978 | Tupper | 5/61 |
| 4,490,867 | 1/1985 | Gabrielsson | 5/109 |

*Primary Examiner*—Carl D. Friedman
*Assistant Examiner*—Creighton Smith
*Attorney, Agent, or Firm*—Marshall & Melhorn

[57] ABSTRACT

An enclosure for a bed to provide protection for patients who would have otherwise required soft restraints to prevent self injury. The enclosure is formed of a supporting framework and an associated covering provided with suitably arranged zippered areas for achieving access to the patient from the exterior of the enclosure.

6 Claims, 6 Drawing Figures

BED ENCLOSURE

BACKGROUND OF THE INVENTION

The invention relates to an enclosure structure for beds and more particularly to an enclosure structure serving to provide a means for a safe environment for the confused, combative, delirious, unattended, or unconscious patients from falling or climbing from the bed.

One of the many problems encountered in the care of the above category of patients is the manner employed to effectively prevent injury to the patient brought about by the patient leaving the bed, either intentionally or unintentionally. Among the obvious reasons for desiring to constrain a patient's locomotion is to assure the maintenance of intravenous equipment, catheters, and the like, as well as to prevent or minimize the opportunities for a patient from unintentionally falling from the bed and causing a bone fracture. Other reasons include the importance of immobilization of a patient to enable proper knitting of broken bones, and incisions or the like.

Body restraints are often employed to achieve the desired immobilization objectives. While such devices are effective, there are attendant disadvantages. The disadvantages include physical discomfort to the patient, physiological discomfort, and an inability to employ such restraint due to the type of infirmity experienced by the patient.

Attempts have been made by the prior art to overcome certain of the aforementioned disadvantages by developing enclosure-type structures for hospital beds. The most pertinent devices known include the structures illustrated and described in U.S. Letter Pat. Nos. 1,087,804 (1914), 1,119,621 (1914), 1,216,719 (1917), 1,708,855 (1929), and 1,948,048 (1934).

Concededly, the thrust of the prior art devices was to solve the same problems sought by the present invention. However, it has been found that the structure of the present invention provides certain inherent advantages over the prior art as will become apparent from the following description.

SUMMARY OF THE INVENTION

It is a primary objective of the present invention to produce a bed enclosure which will overcome or, at least, minimize the disadvantages of the prior devices utilized to confine or restrain patients.

Another object of the present invention is to produce a bed enclosure which will readily and efficiently accommodate hospital-type bed structures, and allow for ready access to the attendant patient from the exterior of the enclosure.

Another object of the invention is to produce a bed enclosure wherein structure is provided to adequately immobilize the bed against any relative movement between the enclosure and the associated bed.

Another object of the invention is to produce a bed enclosure which is not mentally or physically intimidating to the patient.

BRIEF DESCRIPTION OF THE DRAWINGS

The above and other objects and advantages of the invention will become manifest to one skilled in the art from reading the following detailed description of what is now considered to represent its best embodiment when considered in the light of the accompanying drawings, in which.

DETAILED DESCRIPTION OF THE PREFERRED EMBODIMENT OF THE INVENTION

Figure 1:
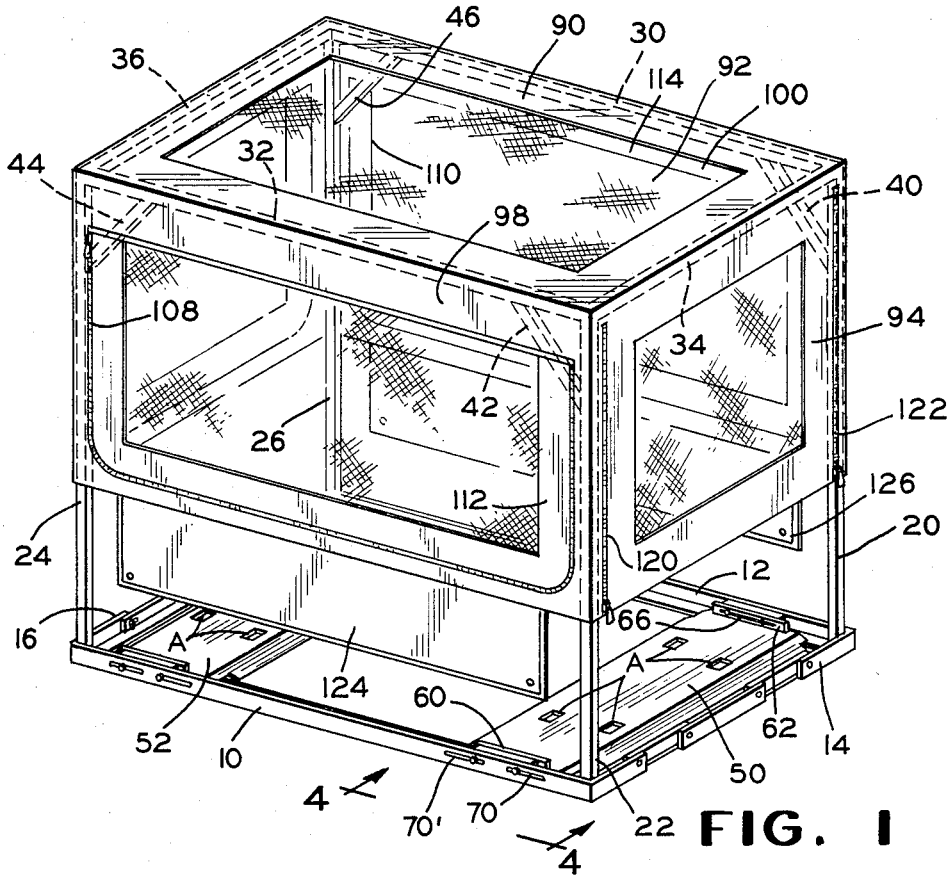
FIG. 1 is a perspective view of a bed enclosure embodying the features of the invention.
Figure 2:
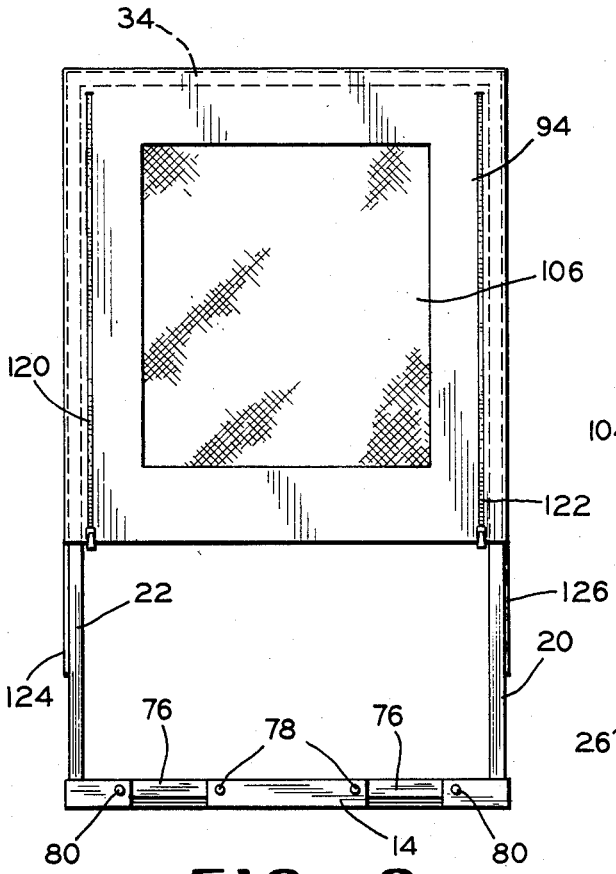
FIG. 2 is a front elevational view of the bed enclosure illustrated in FIG. 1.
Figure 3:
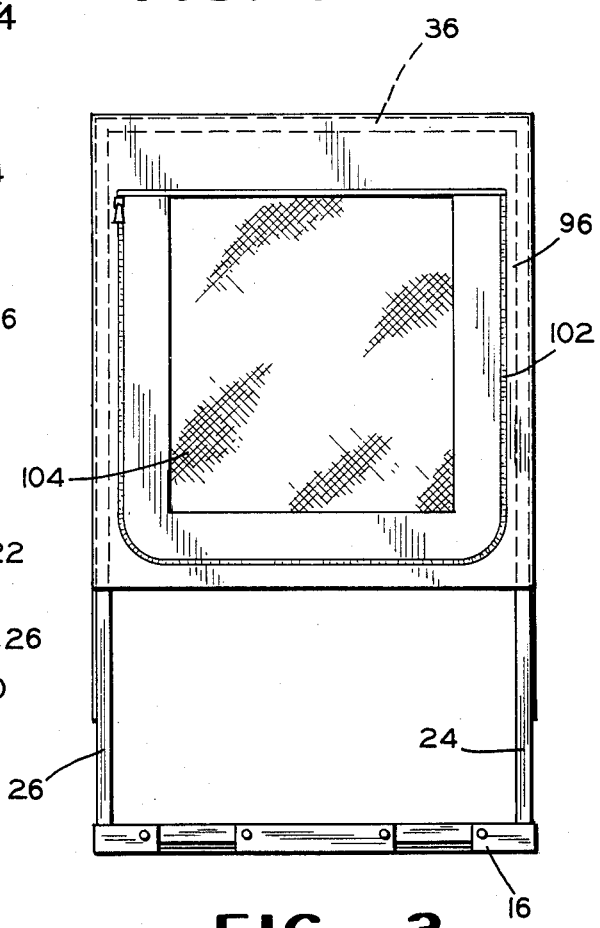
FIG. 3 is a rear elevational view of the bed enclosure illustrated in FIGS. 1 and 2.

Referring to the drawings, there is illustrated in FIGS. 1, 2, and 3 a bed enclosure structure embodying the principle features of the invention. The enclosure includes a ground or floor engaging base frame consisting of spaced apart longitudinally extending parallel side members 10 and 12 having their respective terminal ends connected with the respective terminal ends of transversely extending parallel end members 14 and 16.

The side members 10 and 12 are similar in structure with the end members 14 and 16 and are typically formed of metal stock of generally L-shaped cross-section. The adjoining ends of the members 10, 12, 14 and 16 are typically joined together by welding, for example, to form an overall generally rectangular configuration. It must be understood that while the ends are described as being welded together, other methods and means for joining such as the use of threaded fasteners may be suitably employed.

At each of the various corners of the base frame, there are upwardly extending columnar members 20, 22, 24, and 26 preferably formed of metal stock. The lowermost ends of the members 20, 22, 24, and 26 are suitably secured as by threaded fasteners, welding, or the like, to the base frame. It is preferable that a firm rigid connection is effected between the lowermost ends of the members 20, 22, 24, and 26 and the base frame members to produce the base of a rigid and rugged support framework.

The uppermost ends of the members 20, 22, 24, and 26 are typically secured, by welding for example, to the respective corners of an upper rectangular frame substantially of the same dimensions as the base frame. The upper frame consists of a pair of spaced apart parallel longitudinally extending side members 30 and 32 having their terminal ends connected with the respective terminal ends of a pair of spaced apart parallel transversely extending end members 34 and 36.

Angled supplemental supporting members 40, 42, 44, and 46 are employed to effect rigidity of the overall framework. As illustrated, the members 40, 42, 44, and 46 are adapted to extend between the columnar members 20, 22, 24, and 26 and the respective side members 30 and 32.

Ramp members 50 and 52 are disposed within the confines of the base frame at opposing ends thereof. Since each of the ramp members 50 and 52 is identical with the other, only a single one will be described in detail for simplicity sake. The ramp members 50 and 52 are employed to suitably retain a wheeled hospital-type bed within the confines of the aforementioned framework. More specifically, it will be noted that the ramp member 50 includes a main body portion having oppositely extending inclined leading and trailing edge portions 54 and 56, respectively. The upper edges of the inclined portions 54 and 56 terminate in a flat extended surface section 58. A plurality of suitably positioned, spaced apart apertures A are formed in the flat section 58 and are adapted to receive the wheels of a hospital bed which is rolled into the framework.

Figure 4:
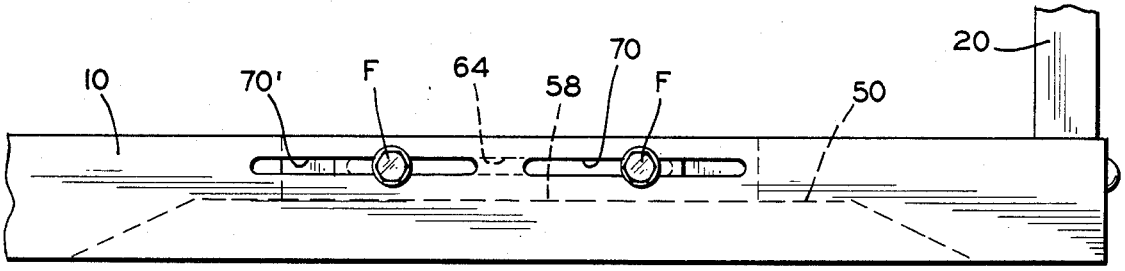
Fig. 4 is an enlarged fragmentary view taken along line 4—4 of FIG. 1 showing the adjustment mechanism for one of the bed wheel support and immobilization plates.
Figure 5:
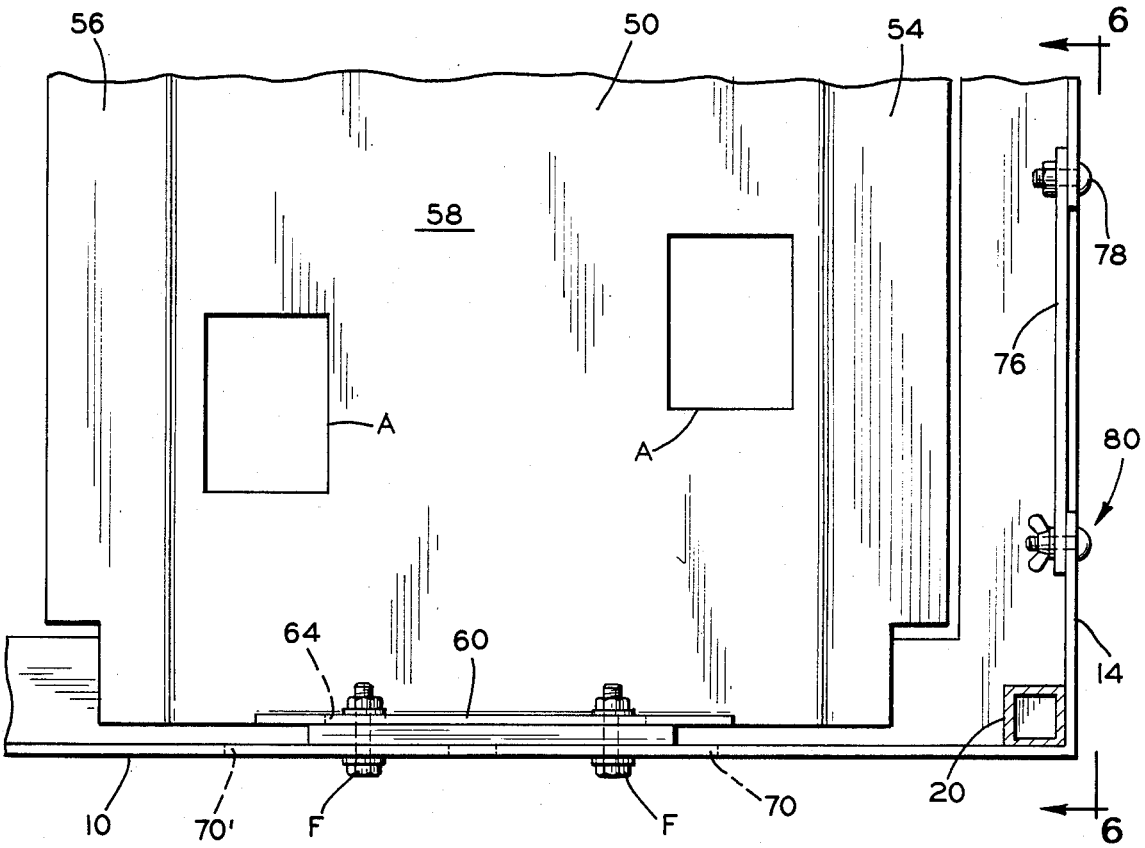
FIG. 5 is a top plan view of the mechanism illustrated in FIG. 4.
Figure 6:
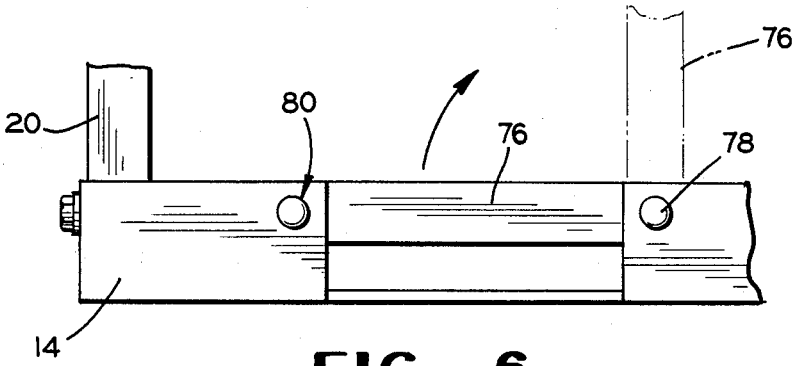
FIG. 6 is an enlarged fragmentary view of the lower portion of the end frame of the bed enclosure taken along line 6—6 of FIG. 5.

It will be appreciated that the opposite side ends of the flat section 58 of the ramp terminate in upwardly extending panels 60 and 62 each provided with elongate horizontally extending slots 64 and 66, respectively. As illustrated clearly in FIGS. 4 and 5, the side member 10 of the base frame is provided with parallel slots 70 and 70', which are formed to extend along the same centerline as the associated slot 64 of the upstanding panel 60 of the ramps. Similar parallel slots (not shown) are provided in the side member 12 and extend along the same centerline as the associated slot 66 of the upstanding panel 62 of the ramps. In order to provide for suitable longitudinal adjustment of the ramps 50 and 52 relative to the base frame, threaded fasteners F are utilized. In this fashion, the position of the ramps 50 and 52 may be readily adjusted relative to the base frame to accommodate beds having varying spaced apart leg configurations.

The end members 14 and 16 of the base frame are equipped with gate-like mechanism to provide for ingress and egress of the associated beds. Since both members 14 and 16 are substantially identical, for simplicity sake, only a single one will be described in detail. In this regard, it will be noted that the end member 14 is provided with the spaced apart openings, each of which may be selectively opened and closed by a gate 76. One end of the gate 76 is mounted for pivotal movement about any suitable pivot means 78; while the opposite end is selectably lockable by locking mechanism 80. The locking mechanism 80, as illustrated, may be a threaded fastener arrangement with a wing nut to enable easy manual manipulation to facilitate the locking or unlocking of the pivotal movement of the associated gate 76. While the drawings illustrate the use of gate-like mechanism in each of the end members 14 and 16, it must be understood that only a single one may be necessary allowing ingress and egress of an associated bed from a single end.

The upper portion of the framework of the bed enclosure is adapted to be covered by a suitable enclosing material primarily formed of a plastic sheet material and cooperating net-like material which is substantially optically transparent. While it will be readily apparent that the particular plastic sheet material and the net-like material may be of varying types, it must be understood that the material and associated stitching or method of adjoining the material together must be strong and rugged enough to withstand the forces of the patient to be confined therein.

Basically the covering of the framework includes a top panel 90 having a central portion 92 formed of a net-like material; end panels 94 and 96; and side panels 98 and 100. The end panel 96, which is typically disposed adjacent the head of the bed to be enclosed, is provided with zipper means 102 adapted to extend around at least three sides of a centrally disposed panel 104 of the net-like material. Manifestly, such structure will provide ready access, from the exterior, to the interior of the enclosure and thus, the patient.

The opposite end panel 94 is typically provided with a central panel 106 of the net-like material.

Each of the sides panels 98 and 100 is provided with zipper means 108 and 110, respectively, which extend around at least three sides of centrally disposed panels 112 and 114 formed of the net-like material. By having the side panels 98 and 100 provided with zippered central portions, ready access to the interior of the enclosure is provided.

Also, in order to enable ingress and egress of an associated bed, the opposite side edges of the panel 94 are provided with zipper means 120 and 122.

It will be understood that the zipper means 102, 108, 110, 120, and 122 are preferably operable only from the outside or exterior of the enclosure to thereby militate against the operation thereof by the patient.

In order to suitably encompass the patient, the covering is provided with depending panels 124 and 126 adapted to be disposed under the mattress of the associated bed and secured to one another by suitable fasteners such as ties, for example.

It will be appreciated from the foregoing description that the invention has produced an enclosure structure providing a safe and unintimidating atmosphere and environment for patients with certain syndromic conditions.

It is believed that the objects and principles of the invention have been described, and in accordance with the provisions of the Patent Laws, the preferred embodiment of the invention has been illustrated and described. However, it is to be understood that the invention may be practiced otherwise than as specifically illustrated without departing from the spirit of the invention as set forth in the appended claims.

What is claimed is:

1. An enclosure for a bed having spaced apart leg supports comprising:

(a) a framework for encompassing the bed, said framework including a floor engaging base frame;

(b) means associated with the floor engaging base frame of said framework including selectively adjustable horizontally disposed plate means provided with spaced apart apertures for retaining the leg supports to militate against relative movement between the bed and said framework; and (c) means for covering said framework to provide a confining zone above the bed and interiorally of said covering means.

2. The invention defined in claim 1 wherein said plate means includes ramp means.

3. The invention defined in claim 1 wherein said covering means includes panels of net-like material.

4. The invention defined in claim 3 wherein at least one of said panels is at least partially surrounded by separable fastening means to provide access to the interior of the zone defined by said covering and the bed.

5. The invention defined in claim 4 wherein said separable fastening means includes a zipper-type fastener.

6. The invention defined in claim 4 wherein said separable fastening means is operable from the outside of said covering means.

* * * * *